US006176270B1

(12) United States Patent
Mettler

(10) Patent No.: US 6,176,270 B1
(45) Date of Patent: Jan. 23, 2001

(54) PAIRED HEDDLES FOR USE ON LOOMS

(75) Inventor: Franz Mettler, Wollerau (CH)

(73) Assignee: Grob Horgen AG, Horgen (CH)

( * ) Notice: Under 35 U.S.C. 154(b), the term of this patent shall be extended for 0 days.

(21) Appl. No.: 09/552,703

(22) Filed: Apr. 19, 2000

(30) Foreign Application Priority Data

Apr. 20, 1999 (DE) ..... 199 17 868

(51) Int. Cl.[7] ..... D03C 9/02
(52) U.S. Cl. ..... 139/93
(58) Field of Search ..... 139/93, 92

(56) References Cited

U.S. PATENT DOCUMENTS 1,970,175 * 8/1934 Kaufmann ..... 139/93
2,047,511 * 7/1936 Kaufmann ..... 139/93
5,078,184 * 1/1992 Koch ..... 139/93
5,176,183 * 1/1993 Koch ..... 139/93

* cited by examiner

*Primary Examiner*—Andy Falik
(74) *Attorney, Agent, or Firm*—Dykema Gossett PLLC

(57) ABSTRACT

Weaving heddles, intended for paired operation, are rendered spring-like resilient in the areas adjacent the end eyes to prevent breakage of the heddles in operation by the high degree of dynamic loading. Such spring-like resiliency is achieved by a provision of a shape change, such as a recess or inwardly bowed section, in the heddles adjacent the end eyes and at a location between the adjacent end eyes and the elongated shaft section of the heddle body.

6 Claims, 3 Drawing Sheets

14"
14
13
12
16
15
6
4
4
4
4
4
14'''
14'
13'
12'
16'
15'
19
28
25
24
30
29

PAIRED HEDDLES FOR USE ON LOOMS

BACKGROUND OF THE INVENTION

This invention relates generally to paired heddles for weaving looms for the production of thickened warp in woven fabrics.

The heddles are paired on the weaving machine to facilitate the weaving of fabric with a heavy warp. Considering a single heddle pair, one of the two heddles is so shaped that its thread eye is positioned in a rear row, and the other heddle of the pair is so shaped that its thread eye is positioned in a forward row. Due to the offset of the thread eyes displaced from the center line of the frame bars on which the heddle pair is mounted upright, such arrangement assures that the passage for the warp even at the broadest part of the heddle, i.e., in the area of the thread eyes, is substantially increased.

Such heddles mounted in pairs are known in the art and are set forth in FIGS. 1, 2 and 9 of the drawings which will be described in more detail hereinafter.

Modern day weaving machines reach very high speeds of rotation resulting in that the loom shafts severely deform in operation because of the high dynamic loadings. This deformation reaches such a level that the play at which the heddles can arrange themselves orderly in a row on the heddle carrier bars of the loom shafts, disappears, and indeed is overcome. When the heddle play is overcome the heddles are stressed in tension along the length thereof. Heddles of modern design which are structured mainly to be symmetrical therefore are deformed into a shape which, at least partially, is inappropriate for the structural loads. Those heddles in the drawings designated 1, 8, 32 and 34 have a high degree of rigidity as compared with heddles 2 and 9. As a result heddles 1, 8, 32 and 34 tend to rapidly deform under tension.

Shown in FIG. 1 is a prior art heddle pair comprising heddles 1 and 2 respectively having centrally located thread eyes 4 and 6 respectively lying along the central axis of that portion of each heddle body which comprises an elongated shaft. The open thread eyes at opposing ends of the shaft provide, as is known in the art, for mounting the heddles in overlying relationship on upper and lower frame bars and/or shafts of the weaving machine (not shown). Thus the thread eyes are offset, to the left and to the right, from the central axis of the frame extending through the upper and lower frame bars.

Heddles 1 and 2 each has a row hole 17 as well as a stamping 18, as known in the art.

Similarly, the prior art heddle pair 8, 9 shown in FIG. 2 is essentially the same as aforedescribed with respect to FIG. 1 except that the end eyes at opposing ends of the shaft of the heddle body of each heddle are C-shaped rather than J-shaped. Thus heddles 8 and 9 respectively contain thread eyes 4 and 5 midway between their ends. In operation, heddle 1 of the heddle pair 1, 2 of FIG. 1 as well as heddle 8 of the heddle pair 8, 9 of FIG. 2, each exhibit a high tensile rigidity in a lengthwise direction, but have a tendency toward rupturing lengthwise, while the other heddles of the pairs, i.e., 2 and 9, respectively, remain undamaged under severe loadings. The reason for this difference in operational behavior could very well be attributed to the fact that the two heddles, 2 and 9, in the area between the end eyes and the thread eyes, i.e., between the end eyes and the heddle shaft, exhibit more resilience as compared to their respective heddles 1 and 8.

SUMMARY OF THE INVENTION

Considering the aforestated disadvantages, it is the object of this invention to provide a heddle, mounted in pairs, which for different types of heddle pairs have enhanced tensile strengths, i.e., a like modulus of elasticity for the heddles of each pair. In keeping with this objective care must be exercised in retaining the full capacity to function as modern heddles, i.e., the heddles must be capable of operating on current weaving machines, they must be transportable in the same manner as before, and they must be able to be installed on the same weaving frame shafts. In accordance with the invention, each heddle of a pair of heddles for a weaving machine comprises a body having an elongated shaft containing a thread eye, and for one type of heddle has open end eyes at opposing ends of the shaft. The end eyes open toward one side of the body. The heddle body of at least one heddle of the pair has a recess adjacent at least one of its end eyes, the recess opening outwardly at a side of the body opposite the one side toward which the thread eye opens. The recess is at a location between the adjacent end eye and the heddle shaft for increasing the resiliency of the heddle along the length thereof. For the heddle pair having closed end eyes at opposite ends of the shafts, the body of at least one heddle of the pair has a recess adjacent at least one of the end eyes opening toward an outer side of the pair. Such recess is likewise at a location between the adjacent end eye and the heddle shaft for increasing the resiliency of the heddle along the length thereof.

Thus the objective of the invention is achieved so that the area adjacent the end eyes of one or both heddles of the pair, which area is relatively rigid as to extension, is rendered spring-like resilient, specifically by shaping that area between the adjacent end eye and the heddle shaft.

Thus one or both heddles of the pair, at a location between the thread eye and its end eye, the nearer it approaches the end eye or the area of the end eye exhibits a change in shape, such as a recess or an inwardly bowed section. This area of the end eye is otherwise designed to be open.

The open recess provided at such location for one or both heddles of the pair in the area adjacent the end eye or eyes, may be in the form of a bowed portion which imparts a spring-like characteristic to that area.

Other objects, advantages and novel features of the invention will become more apparently from the following detailed description of the invention when taken into conjunction with the accompanying drawings.

DETAILED DESCRIPTION OF THE INVENTION

Figure 1:
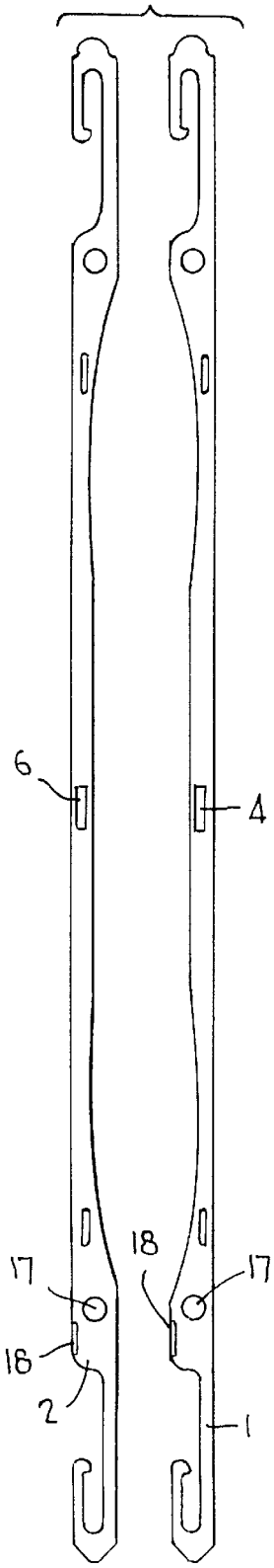
FIG. 1 (PRIOR ART)
FIG. 1 is a top plan view of a pair of heddles according to the prior art having J-shaped end eyes.
Figure 2:
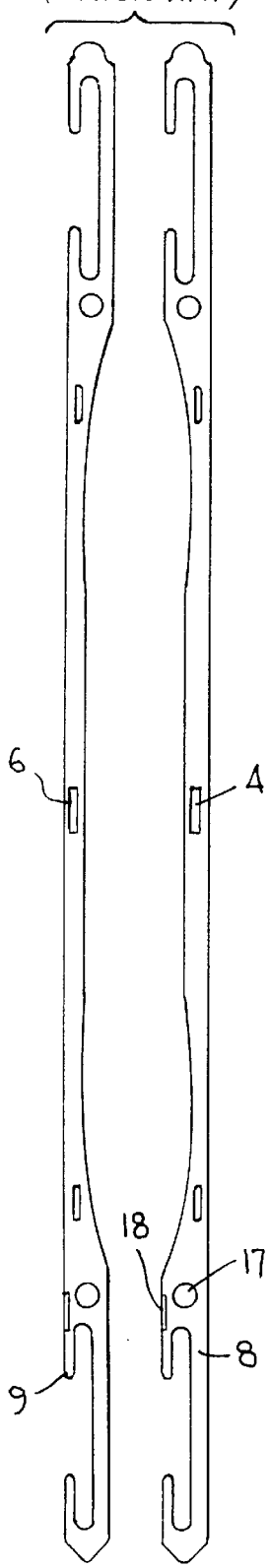
FIG. 2 (PRIOR ART)
FIG. 2 is a plan view of a pair of heddles according to the prior art having C-shaped end eyes.
Figure 3:
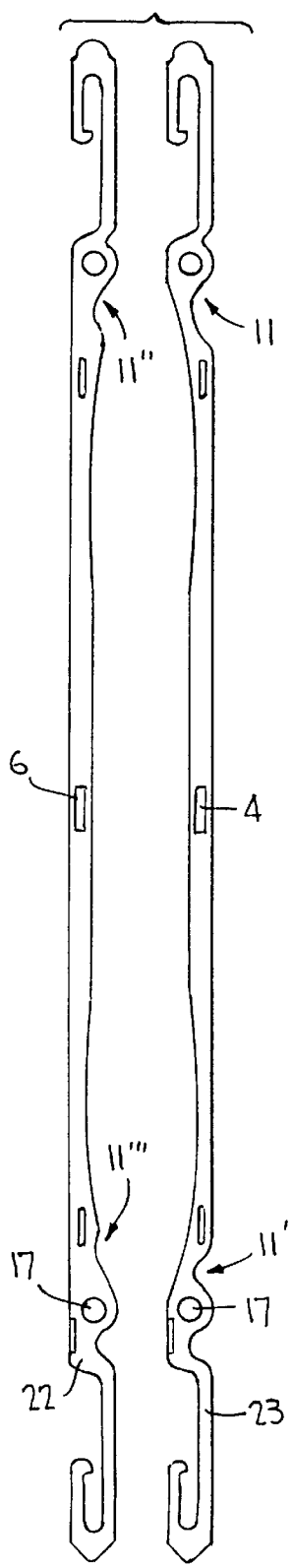
FIG. 3 is a top plan view of a heddle pair incorporating the invention, each heddle having C-shaped end eyes.
Figures 4, 5, 6, 7, 8:
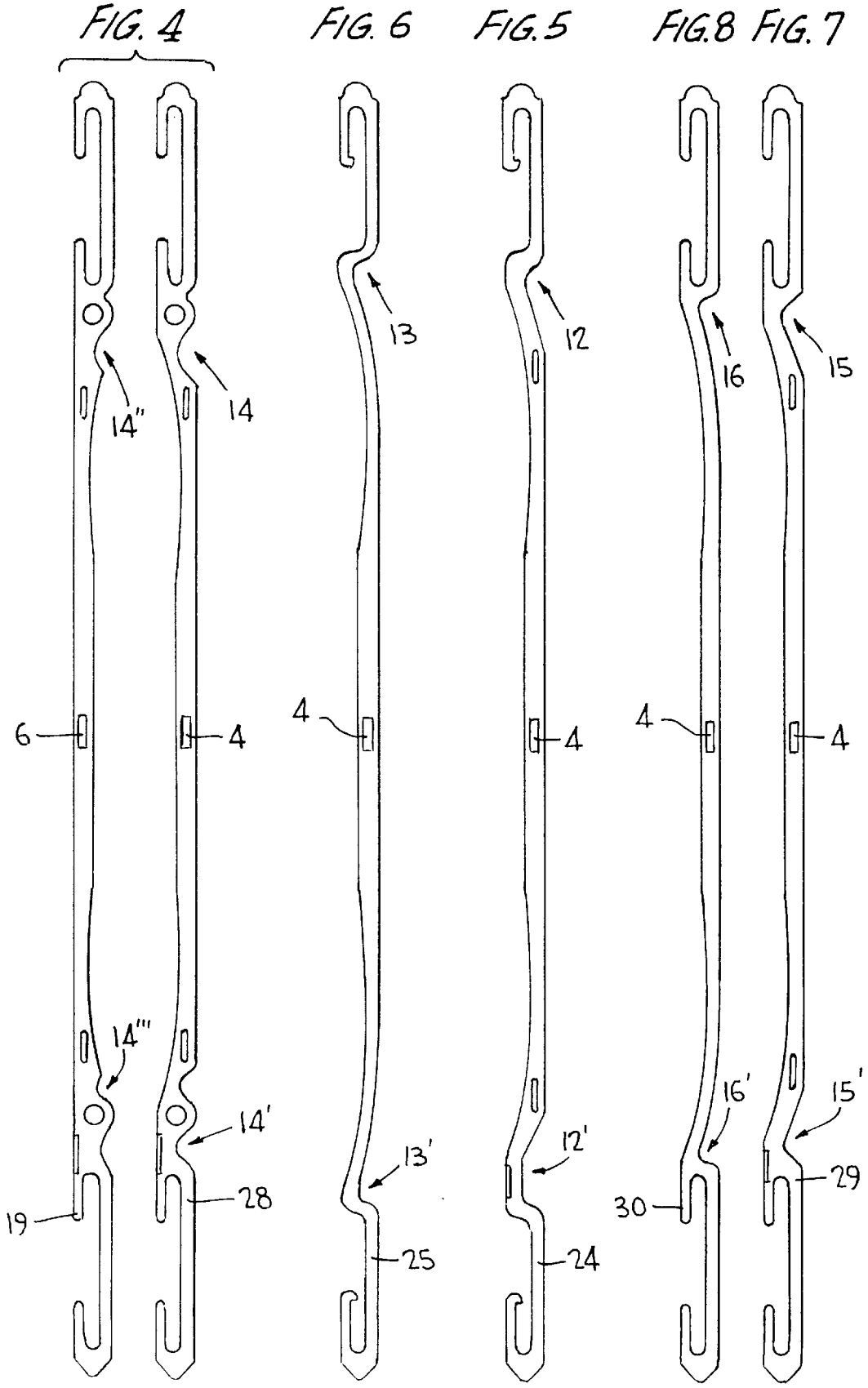
FIG. 4 is a plan view of a heddle pair incorporating the invention with each heddle having C-shaped end eyes.
FIG. 5 is a top plan view of a heddle to be installed in pairs and incorporating the invention, the heddle having J-shaped end eyes.
FIGS. 6–8 is a view similar to FIG. 5 of another heddle incorporating the invention to be mounted as a pair and having J-shaped end eyes.

The present invention has for its objective a manner of avoiding the drawbacks of prior art heddle pairs as discussed above, in that two heddles of the heddle pair, shown in FIGS. 3 and 4, for example, are designed to be resilient in a spring-like manner between their respectively end eyes and their thread eyes. This condition is achieved for heddle 23 of FIG. 3 by the provision of recesses 11, 11' respectively adjacent the thread eyes of the heddle and being at a location between that adjacent end eye and the thread eye of the heddle, i.e., between the adjacent end eye and the heddle shaft. Likewise heddle 28 of FIG. 4 has recesses 14, 14' respectively adjacent the end eye at opposite ends of the elongated shaft of the body of the heddle, and each recess being located between such adjacent end eye and the heddle shaft. The open end eyes of FIG. 3 open toward one side of the heddle body, and recesses 11, 11' according to the invention open outwardly at a side of the heddle body opposite the side toward which the end eyes open. Similarly opposing end eyes of heddle 28 of FIG. 4 open toward one side of the heddle body, while the recesses the 14 and 14' of the invention open toward an opposite side of that body.

Similar recesses are provided for each of the other two heddles 22 and 19 of the pairs such that for heddle 22, recesses 11" and 11'" are provided respectively adjacent the end eyes and at a location between their respective adjacent end eyes and the elongated shaft portion of the heddle. Likewise heddle 19 of FIG. 4 has recesses 14" and 14'" respectively adjacent the end eyes and at locations between the adjacent end eyes and the elongated shaft portion of the heddle. And the recesses for heddles 22 and 19 open toward a side opposite that side toward which the end eyes open. The recesses for these heddles provide spring-like resilience in the area between the respectively end eyes and the elongated shaft portion of the heddle.

Additional variants of heddles are presented in FIGS. 5, 6, 7 and 8, which respectively illustrate only 1 heddle of the pair since the other heddles for the respective pairs need not be illustrated, given that, as in heddles 2, 9, 22, 19, for the heddle pairs of FIGS. 1 to 4, these heddles remain undamaged under high loads under most circumstances. All heddles illustrated in FIGS. 5 to 8 have a common feature, i.e., at a location between the end eyes and the elongated shaft portion of the heddle body recesses which may be in the form of inwardly bowed sections are formed such as 12, 12', 13, 13', 15, 15' and 16, 16'. Each of these sections bow inwardly from the same side of the heddle which side is opposite that side of the respective heddles to which the end eyes open. Thus the bowed sections in effect open in a direction toward one side of the body of the heddle which is opposite that side to which the end eyes open.

Heddles 24, 25, 29 and 30 respectively of FIGS. 5 to 8 can be combined with other heddles, for example, such as heddle 9 being combinable with either of heddles 24, 25, or such as heddle 9 being combinable with either of heddles 29 and 30. It can be therefore seen that when combining these heddles into pairs, their heddle designs can be utilized which more or less correspond to the 4 shown in FIGS. 5 to 8. According to the invention if both heddles of the heddle pair are spring-like resilient or flexible in that area between the end eyes and the elongated shaft portion of the heddle in order to prevent damage at operations at a high load.

Figure 9:
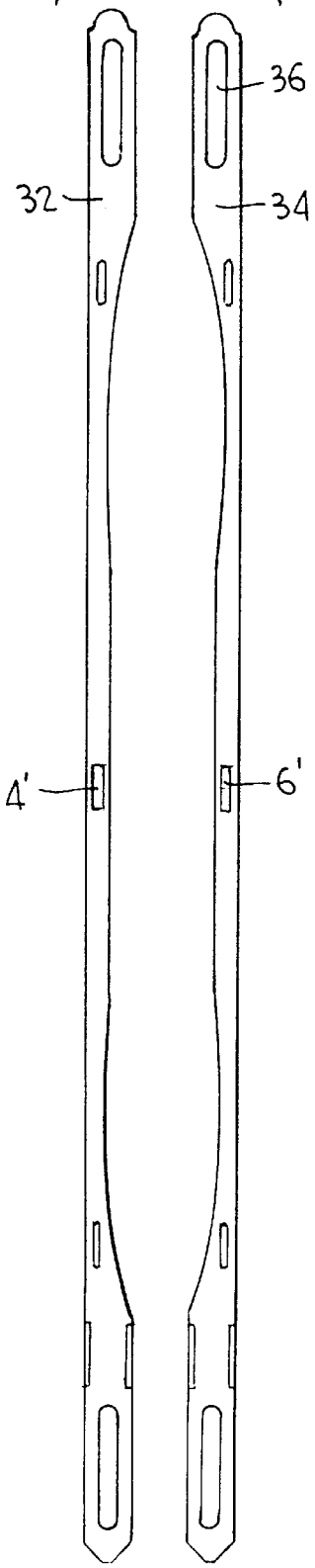
FIG. 9 (PRIOR ART)
FIG. 9 is a top plan view of a pair of heddles according to the prior art having closed end eyes.
Figure 10:
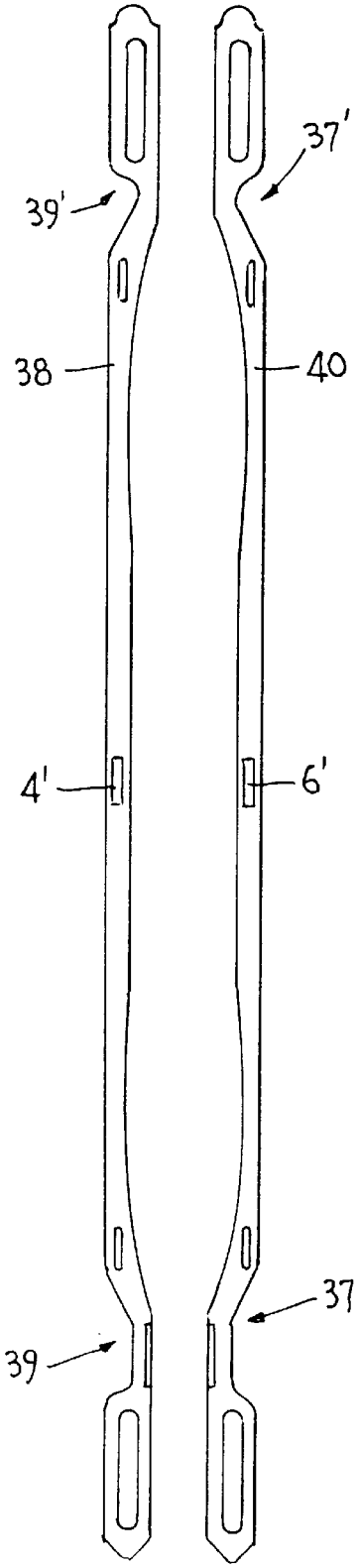
FIG. 10 is a top plan view of a heddle pair having closed end eyes and incorporating the invention.
Figure 11:
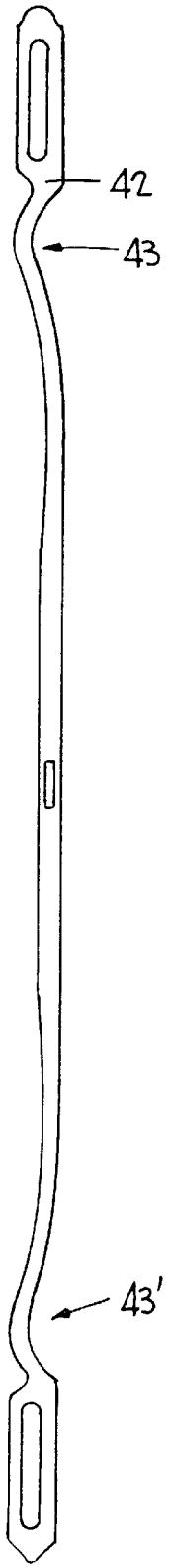
FIG. 11 is a top plan view of a heddle to be installed as a heddle pair incorporating the invention and having closed end eyes.

While the heddles shown in FIGS. 1 to 8 illustrate open end eyes, the invention is likewise adaptable for heddles of FIGS. 9 to 11 having closed end eyes such as 36 shown in FIG. 9. Similarly as in heddles having open end eyes, the heddle of FIGS. 9, 10 and 11 having closed end eyes have thread eyes 4', 6' located in the middle of the heddle and respectively lying along the longitudinal axes of the elongated shafts of the heddles 1 and to the other side of central axis extending through the upper and lower heddle frame bars on which the heddle pairs are mounted, so as to be offset from that axis. Contrary to the heddle pairs shown in FIGS. 1 and 2, both heddles of the FIG. 9 pair exhibit high elongation rigidity such that upon a high loading both heddles tend to fracture under loadings. Accordingly, both heddles of the heddle pair are to be modified in accordance with the invention as, for example, shown in FIG. 10. There heddles 38 and 40 have respective recesses in the form of inwardly bowed sections 37, 37' and 39, 39', respectively, which bowed sections open toward an outer side of the heddle pair. And the respective recesses are adjacent the end eyes of the pair as shown, and are at a location between that adjacent end eye and the thread eye, i.e., between the adjacent end eye and the elongated shaft section of the heddle body. By the provision of such recesses, the resiliency of the heddles of each pair are increased along the length thereof.

For those heddles which do not require a stamping 18 such as that shown in FIGS. 1 to 4, which is required in order to be used on the entry machine, the heddles may be shaped as in FIGS. 6 or 8, which the recesses 13, 13' and 16, 16' impart to the respective heddles a certain ideal form.

The aforedescribed recesses according to the invention may have a depth equal to at least one-half the width of the elongated shaft portion of the heddle.

Obviously, the shaping of the heddles in accordance with the invention is made possible for any type of a heddle intended for a paired installation. Thus all heddles lie within the limits of the invention, such as those heddles showing distortion, which separates the heddles from one another, those heddles with easily twisted thread eyes, those heddles which in the area of the thread eyes exhibit squeezing, or those heddles in which the end eyes demonstrate by compression a greater breadth than the breadth of the heddle itself, etc.

Thus the present invention is not limited to the examples shown in FIGS. 1 to 11, but encompasses fundamentally every type of heddle to be used in paired arrangement and which are designed in accordance with the invention.

Obviously, many modifications and variations of the present invention are made possible in the light of the above teachings. It is therefore to be understood that within the scope of the appended claims, the invention may be practiced otherwise than as specifically described.

What is claimed is:

1. A heddle pair for a weaving machine, each heddle of the pair comprising a body having an elongated shaft containing a thread eye, open end eyes at opposing ends of said shaft, said end eyes opening toward one side of the body, the improvement wherein said body of each heddle of the pair has a recess adjacent at least one of said end eyes thereof opening outwardly at a side of said body opposite said one side, said recess being at a location between said adjacent end eye and said elongated shaft for increasing the resiliency of the heddle along the length thereof.

2. A heddle pair for a weaving machine, each heddle of the pair comprising a body having an elongated shaft containing a thread eye, closed end eyes at opposing ends of said shaft, the improvement wherein said body of each heddle of the pair has a recess adjacent at least one of said end eyes opening toward an outer side of the pair, each said recess being at a location between said adjacent end eye and said elongated shaft for increasing the resiliency of the heddle along the length thereof.

3. The heddle pair according to claim 1, wherein said body of each heddle of the pair has said recess adjacent each of said end eyes of said heddle, each said recess opening outwardly at the opposite side of said body of each heddle, and each said recess being at a location between said adjacent end eye at opposing ends of each said shaft and said elongated shaft of each said heddle.

4. The heddle pair according to claim 2, wherein said body of each heddle of the pair has said recess adjacent each of said end eyes of each said heddle, each said recess opening toward outer sides of the pair, and each said recess being at a location between said adjacent end eye at opposing ends of each said shaft and said elongated shaft of each said heddle.

5. The heddle pair according to claims 1, 2, 3 or 4, wherein said elongated shaft has a predetermined width, said recess having a depth equal to at least one-half said width.

6. The heddle pair according to claims 1, 2, 3 or 4, wherein said body at said location is bowed to define said recess.

* * * * *